US005683044A

United States Patent [19]

Gueldenpfennig et al.

[11] Patent Number: 5,683,044

[45] Date of Patent: Nov. 4, 1997

[54] PROCESS-OPTIMIZED HAMMER MILL

[75] Inventors: Martin Gueldenpfennig, Ulm; Joachim Pfitscher, Nersingen, both of Germany

[73] Assignee: Daimler-Benz AG, Stuttgart, Germany

[21] Appl. No.: 612,287

[22] Filed: Mar. 7, 1996

[30] Foreign Application Priority Data

Mar. 7, 1995 [DE] Germany ..... 195 07 958.2

[51] Int. Cl.[6] ..... B02C 13/286

[52] U.S. Cl. ..... 241/73; 241/186.2; 241/194; 241/14

[58] Field of Search ..... 241/101.3, 14, 241/73, 189.1, 186.2, 186.3, 186.4, 194, 199.12

[56] References Cited

U.S. PATENT DOCUMENTS

| | | | |
|---|---|---|---|
| 1,301,316 | 4/1919 | Plaisted | 241/194 |
| 1,622,849 | 3/1927 | Ruprecht et al. . | |
| 1,920,947 | 8/1933 | Armstrong | 241/194 |
| 2,837,290 | 6/1958 | Nagel | 241/186.2 X |
| 5,297,741 | 3/1994 | Zurn et al. | 241/19 |

FOREIGN PATENT DOCUMENTS

| | | | |
|---|---|---|---|
| 1323314 | 2/1963 | France | 241/186.2 |
| 685 719 | 12/1939 | Germany . | |
| 816 784 | 10/1951 | Germany . | |
| 1 085 403 | 7/1960 | Germany . | |
| 32 45 199 | 6/1984 | Germany . | |
| 42 16 638 | 9/1993 | Germany . | |

*Primary Examiner*—Mark Rosenbaum

*Attorney, Agent, or Firm*—Evenson, McKeown, Edwards & Lenahan, P.L.L.C.

[57] ABSTRACT

A hammer mill for batchwise operation has a mill housing having a perforated screening plate intended for discharging a fine fraction of the milling material. A coarse fraction of the milling material is emptied through an emptying flap. A supply shaft opens tangentially into the milling chamber. The supply shaft is closed by a movable closure wall. In order to maintain short consistent treatment times of the milling material and to precisely reproduce a specific degree of filling for the treatment space, the supply shaft is dimensioned such that it can receive more than a milling-chamber fill. The movable closure wall is displaceable back and forth between a raised standby position and a lowered operating position such that the milling material introduced into the supply shaft when the closure wall is raised is forced into the milling chamber and then held therein by the closure wall being displaced in the direction of the milling chamber. An introduction opening is provided beneath the standby position of the closure wall in the supply shaft. The receiving volume of the supply shaft, which volume is located beneath the introduction opening, is large enough for a complete milling-chamber fill to be readily received.

7 Claims, 1 Drawing Sheet

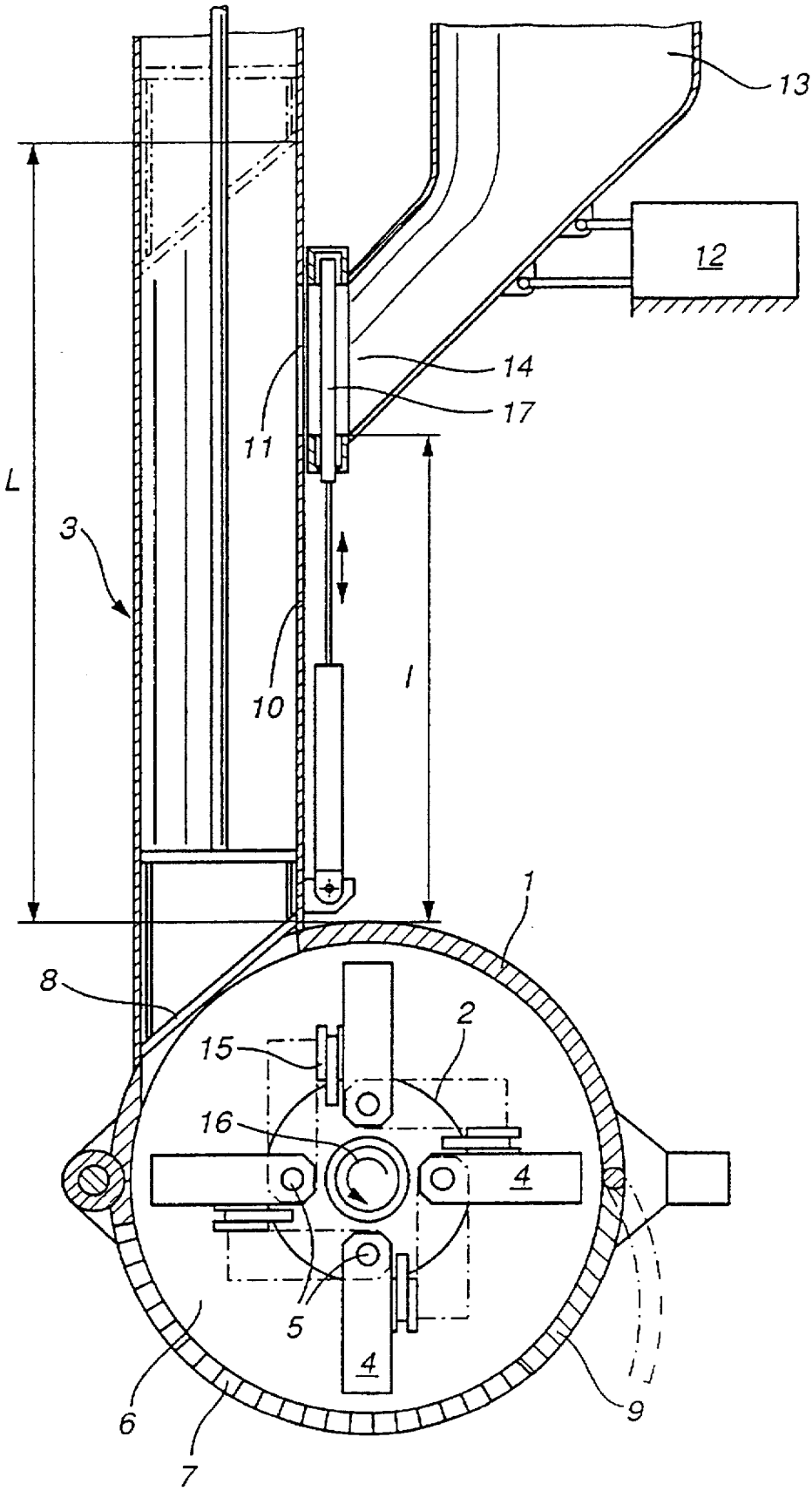
13
12
14
17
11
L
3
10
l
1
8
2
15
16
4
5
4
6
7
9

PROCESS-OPTIMIZED HAMMER MILL

BACKGROUND AND SUMMARY OF THE INVENTION

The invention relates to a hammer mill for batchwise operation, i.e. in the case of which the introduced milling material is held in the milling chamber for a specific treatment time. The hammer mill has a rotor which is driven in rotation and is fitted with pendulum-mounted hammers. The hammer mill further has a stationary mill housing which surrounds the rotor and, in the rotor region, encloses a cylindrical milling chamber which is preferably designed, on the circumferential section located at the bottom in the direction of gravitational force, as a perforated screening plate for continuously and automatically discharging a fine fraction of the milling material. A supply shaft is provided which opens tangentially into the milling chamber, preferably from the top in the direction of gravitational force, and is intended for milling material to be treated. The supply shaft can be closed by a movable closure wall in the region of the transition between the milling chamber and the supply shaft. An emptying flap, slide, or the like, is also provided which is fitted on the milling chamber, preferably at the bottom in the direction of gravitational force and is intended for discharging a coarse fraction of the milling material from the milling chamber in a batchwise manner.

A hammer mill of the above-mentioned type is disclosed, for example, in German Patent Document DE 42 16 638 C1. This document presents a process for breaking up and sorting the different plastics of composite components which are to be recycled. The composite components comprise a substrate consisting of relatively thick-walled rigid plastic, an intermediate layer which is attached in a firmly adhering manner to the substrate and consists of foam, and a flexible film which adheres firmly on the outer sides of the intermediate layer and is formed with a thinner wall than the substrate. The composite components are first of all comminuted to form approximately cube-shaped or else strip-shaped particles, preferably of a particle size or cross-sectional edge length of approximately 20 mm, still made up of different plastics. Subsequently, a dry method is used to break up the formed particles into their individual materials and to sort the latter. For this purpose, the less fracture-resistant foam of the particles is selectively comminuted in a mechanical manner, by the particles being subjected to impact, to form fragments which are considerably smaller than the rest of the particles, which consist of a more fraction-resistant plastic. The smaller foam fragments are separated from the coarser residual particles by screening. The two operations—breaking up the composite particles with selective comminution of the foam portions and screening the foam fragments—take place in a hammer mill which is operated in a batchwise manner and has an integrated screening plate. In the case of three-material composite components, the initially remaining mixture of thick-walled, rigid-plastic pieces and thin-walled shreds of film is subsequently sorted by use of vertical, low-turbulence air separation.

When breaking down or breaking up the composite particles by use of the hammer mill, it is essential for careful treatment of the components that, in batchwise operation, the treatment times are very short and that the treatment times established as being optimum for the materials concerned are maintained accurately to the second as far as possible. If treatment is carried out for too long, the plastic in the hammer mill heats up and this results in sticking, clogging or blockage. This severely disrupts operation and can only be eliminated in an extremely time-consuming manner. On the other hand, it is necessary for a certain minimum treatment period to be maintained for all the particles contained in the respective batch, in order that the result achieved after breaking up or separating is a viable one. The situation where some of the particles are not yet fully broken up into the individual material components should be avoided as far as possible. Difficulties are posed here, in particular, by rapid and complete filling of the treatment space of the hammer mill. On account of delayed filling, which may be caused, for example, by a jam in the introduction shaft or, in some circumstances, also by a certain returning effect of the milling unit, the particles which are first to enter the treatment space are treated for a longer period than the particles which are last to enter. This difference in the treatment time~of the particles is in no way negligible with respect to the average overall duration of the treatment.

It must therefore be taken into account, in this connection, that it is not only the case that the treatment duration for a batch should be approximately the same for all batches and for all particles of the batch, but also that an equal degree of filling of the treatment space of the hammer mill should be maintained in a precisely reproducible manner for all batches, since the degree of filling also has a bearing on the result. On account of this, delayed filling and/or filling which differs from batch to batch has an adverse effect on the result of the process, namely on clean and complete breaking-up of the composite.

German Patent Document DE-PS 816 784 describes an introduction device for a mill designated as a centrifugal mill. It is the intention for the introduction device to prevent, on the one hand, bridging of milling material within the supply shaft, but also, on the other hand, the dangerous flinging-back of milling material from the supply shaft by the milling unit. The known introduction device exhibits a supply shaft which tapers in the introduction direction, is arranged on the axial end side of the rotational symmetrical milling chamber, and opens into the milling chamber approximately centrally, with eccentricity offset slightly downward.

Fitted close together at the top end of the supply shaft are two pivotable closure flaps. The inner flap can only be pivoted into the shaft, whereas the outer flap can only be opened outwards. The two flaps are expediently connected rigidly to one another, approximately at right angles with respect to one another, and can be pivoted together about a common axis. In the raised, i.e. closed, position, the inner closure flap can be secured against the action of gravitational force. The outer flap is provided with a manually displaceable push rod which is guided such that it can be moved at right angles with respect to the flap plane and at whose shaft-side end a pressure-exerting plate is fastened in the manner of a piston. When the inner flap is closed and the outer flap is open and the pressure-exerting plate is drawn back right up against it, the angular space enclosed between the two forms a standby space for new milling material. This milling material held on standby can be introduced into the supply shaft, without the risk of milling material being flung out, by the two flaps being pivoted at the same time.

In the closed position of the outer flap, the milling material located in the supply shaft can be forced in the direction of the milling chamber by the push rod and the pressure-exerting plate, but cannot be pushed into the milling chamber to the full extent. This is due to the fact that the supply shaft is arranged axially on the milling chamber and at an angle of approximately 45° with respect to the axis of rotation.

The pressure-exerting plate, which is arranged in the supply shaft such that it is inclined with respect to the plane of rotation, must not come too close to the milling chamber, otherwise it would come into contact with the milling unit and be damaged. In this arrangement, a wedge-shaped residual volume remains between the milling unit and the pressure-exerting plate, which residual volume is approximately the same size as the standby space between the two flaps at the top end of the supply shaft. Accordingly, the known introduction device cannot be used for rapid and complete introduction of milling material into the milling chamber. The known introduction device has also been unable in other respects to provide a person skilled in the art with any indications as to how to optimize the process for a selective milling action of hammer mills.

U.S. Pat. No. 1,622,849 describes a hammer mill with a supply shaft tapering radially to the circumference of the round milling chamber. The supply shaft is arranged such that it is inclined at approximately 45° with respect to the direction of gravitational force. The milling material is forced into the milling chamber by a conveying screw which runs in the interior of the cylindrical supply shaft and fills the clear cross section thereof to the full extent. The hammer mill is designed for continuous operation, in the case of which all the constituent parts of the milling material are passed through the milling chamber completely and are treated uniformly by the milling unit. It is also the case that this publication has been unable to provide a person skilled in the art with any indications as regards selective treatment of specific fractions of the milling material and of optimizing the process for the hammer mill in this respect.

German Patent Document DE-AS 10 85 403 apparently shows a non-symmetrical pivot path limitation of the hammers of a hammer mill, it being the case, however, that the non-symmetry is deduced merely from the drawing and is neither expressly mentioned in the description nor discloses itself to a person skilled in the art in the described context as a whole. It could thus be the case that the non-symmetry of the pivot-path limitation is also an unintentional inaccuracy in the drawing. Moreover, in German Patent Document DE-AS 10 85 403—in contrast to an expedient configuration of the present invention—the leading pivot range (approximately 67°) of the hammers is illustrated as being greater than the trailing pivot range (approximately 33°).

There is therefore needed an improved hammer mill to the effect that the hammer mill is optimized for a selective comminution action and careful treatment of the milling material and, in this respect, favorable process conditions are created.

These needs are meet according to the present invention by a hammer mill for batchwise operation, i.e. in the case of which the introduced milling material is held in the milling chamber for a specific treatment time. The hammer mill has a rotor which is driven in rotation and is fitted with pendulum-mounted hammers. The hammer mill further has a stationary mill housing which surrounds the rotor and, in the rotor region, encloses a cylindrical milling chamber which is preferably designed, on the circumferential section located at the bottom in the direction of gravitational force, as a perforated screening plate for continuously and automatically discharging a fine fraction of the milling material. A supply shaft is provided which opens tangentially into the milling chamber, preferably from the top in the direction of gravitational force, and is intended for milling material to be treated. The supply shaft can be closed by a movable closure wall in the region of the transition between the milling chamber and the supply shaft. An emptying flap, slide, or the like, is also provided which is fitted on the milling chamber, preferably at the bottom in the direction of gravitational force and is intended for discharging a coarse fraction of the milling material from the milling chamber in a batchwise manner. In terms of its clear cross-section and its length, the supply shaft, of rectilinear and prismatic design, has a capacity which is dimensioned such that when compared with the milling chamber being filled to the full extent with a loose fill of milling material, the supply shaft can receive at least 1.1 times, (preferably approximately 1.5 times), a milling-chamber fill. The movable closure wall can be displaced back and forth by a longitudinal guide in the supply shaft—along its length—between a raised standby position and an operating position lowered onto the circumference of the milling chamber. This can be done such that the milling material introduced into the supply shaft when the closure wall is raised can be forced into the milling chamber, and then held therein, by the closure wall being displaced in the direction of the milling chamber. An introduction opening is provided beneath the raised, standby, position of the closure wall, in a side wall of the supply shaft. The receiving volume of the supply shaft which is located beneath the introduction opening is large enough for a complete milling-chamber fill to be received readily therein. Fitted on the outside in front of the introduction opening provided on the supply shaft is an introduction hopper which can be closed at the bottom, receives a milling-chamber fill and the discharge opening of which opens into the introduction opening of the supply shaft. The pivot path of the hammers is limited to the rear, at least in the direction of rotation, by stops which are arranged such that the forced-back striking position of the hammer or hammers corresponds approximately to the tangential position directed rearwards in the direction of rotation or to a position pivoted by not more than approximately 10° beyond the tangential position, such that the hammers in the rearward striking position project, via their leading longitudinal side, beyond the discs of the rotor which bear the hammers.

Through the use of the invention, in the case of batchwise operation of the hammer mill, short treatment times of the milling material are maintained accurately approximately to the second for all the particles of a batch and filling time-related time differences in the treatment for individual particles are avoided. Furthermore, a specific, relatively high degree of filling of the treatment space can be maintained in a precisely reproducible manner from batch to batch.

By virtue of the filling and pressing-in device according to the present invention, it is possible for more material to be introduced than can be drawn in automatically by the milling unit. In the case of a high loading density, as can be achieved when using the pressing-in device, favorable preconditions for selective comminution are created within the milling chamber, and the typical comminution operations which are necessary or desired here take place. While, with low loading of the milling chamber, the milling material is subjected virtually exclusively to impact, one can observe, in the case of high loading, that the material is primarily subjected to striking and friction.

Since the striking and friction operations act on the milling material considerably less severely than impact operations, the striking and friction action can be utilized specifically for selective comminution of only those components of the composite material which are most sensitive to fracture. On account of the duration, accurate to the second, over which the batch is subjected to such action, no material is subjected to the action for an unnecessarily long period of time, i.e. there is no loss of the rotor fraction which remains in the milling chamber, for example on account of the treatment duration being slightly too long. Consequently, on the one hand, the rotor-fraction yield is high and, on the other hand, the contamination of the selectively comminuted—screening fraction is minimal. If the duration of treatment is too long, plastics may be heated up to a considerable extent. This can result in thermal degradation of the polymer and in an undesired plastifying and sticking together of individual particles.

Other objects, advantages and novel features of the present invention will become apparent from the following detailed description of the invention when considered in conjunction with the accompanying drawings.

BRIEF DESCRIPTION OF THE DRAWINGS

The sole drawing FIGURE is a cross-sectional view through a hammer mill according to the present invention.

DETAILED DESCRIPTION OF THE DRAWINGS

The hammer mill represented in the FIGURE is intended for batchwise operation, as is used, in particular, for the selective comminution of milling material. In this arrangement, the milling material introduced is held, and milled, in the milling chamber for a certain treatment time. Only a classifiable specific fraction of the milling material is selectively comminuted and the rest of the milling material remaining is essentially unaffected. The hammer mill exhibits a rotor 2 which is driven in rotation and is fitted with pendulum-mounted hammers 4. The hammers 4 are suspended on the circumference of the rotor via pivot joints 5. The rotor 2 is surrounded by a stationary mill housing 1 which, in the rotor region, encloses a cylindrical milling chamber 6. The latter is designed, on the circumferential section located at the bottom in the direction of gravitational force, as a perforated screening plate 7 for continuously and automatically discharging a fine fraction of the milling material. A supply shaft 3 opens tangentially into the milling chamber from the top in the direction of gravitational force, is intended for milling material to be treated, and can be closed by a movable closure wall 8 in the region of the transition between the milling chamber 6 and the supply shaft 3. An emptying flap 9 is fitted on the milling chamber 6 at the bottom in the direction of gravitational force and is intended for discharging a coarse fraction of the milling material from the milling chamber 6 in a batchwise manner.

For the case of batchwise operation of the hammer mill, in order to be able to maintain approximately consistent short treatment times of the milling material for all the particles of a batch, and to be able to precisely reproduce a specific degree of filling of the treatment space from batch to batch, an improved introduction device formed on the supply shaft 3 is provided for the hammer mill. For this purpose, the supply shaft 3 is of a rectilinear and prismatic design, in order that the closure wall 8 can be guided up and down in it. In terms of its clear cross-section and its length L, the supply shaft 3 has a capacity which is dimensioned such that it can receive at least 1.1 times, preferably approximately 1.5 times, a complete milling-chamber fill. This is based on a loose fill of the milling material.

The closure wall 8, which can be moved in the supply shaft 3, can be displaced back and forth by a longitudinal guide (not shown in any more detail) in the supply shaft 3—along its length—between a raised standby position, indicated by dash-dotted lines, and an operating position lowered onto the circumference of the milling chamber 6 and represented by solid lines. Consequently, the milling material which has been introduced into the supply shaft 3 when the closure wall 8 is raised can be forced into the milling chamber 6, and then held therein, by the closure wall 8 being pushed downwards in the direction of the milling chamber 6.

An introduction opening 11 is provided beneath the raised, i.e. standby, position of the closure wall 8, in a side wall 10 of the supply shaft. The length 1 from the top edge of the housing 1 to the bottom edge of the introduction opening 11 is inherently smaller than the overall length L of the supply shaft between the top edge of the housing 1 and the standby position of the closure wall 8.

The receiving volume of the supply shaft 3 which is located beneath the introduction opening 11 is large enough for a complete milling-chamber fill to be received readily in the supply shaft up to the bottom edge of the introduction opening 11.

Fitted on the outside in front of the introduction opening 11 is a weighing machine 12 with a hopper-like receiving device 13 for material to be weighed, the discharge opening 14 of the receiving device opening into the introduction opening of the supply shaft. The discharge opening 14 can be closed by a closure slide 17. Although the receiving device and the closure slides 17 can be moved in a fully unobstructed manner in a vertical direction with respect to the supply shaft 3 within the limits of the weighing movement, they are otherwise assigned in a constant position relative to the supply shaft 3.

A milling cycle using the hammer mill shown proceeds, then, as follows: during the treatment time for a batch which has previously been introduced, new milling material is introduced into the hopper-like receiving device 13 for the material to be weighed, the weighing machine 12 constantly indicating the quantity introduced. During this time, the closure slide 17 is located in the closed position represented in the FIGURE. The weighing machine 12 permits a predetermined desired quantity to be weighed out. During treatment of a batch in the hammer mill 1, the closure wall 8 in the supply shaft 3 is held in the operating position, illustrated by solid lines. During treatment of the batch previously introduced into the hammer mill, the new weighed quantity is held on standby in the bottom part of the receiving device 13, in front of the closed closure slide 17.

During treatment of the milling material previously introduced into the hammer mill, the milling material is selectively comminuted. The comminuted fraction is continuously discharged downwards through the perforated screening plate 7 until this portion in the milling material has been fully eliminated from the milling material and the milling chamber contains only coarse fractions which are not to be comminuted. In the case of great differences in hardness between the individual material fractions of the milling material, such selective comminution is easily possible and is achieved after only a short treatment duration. In order to avoid degradation of the remaining coarse fraction, the milling operation should be discontinued very quickly after the soft fraction has been fully comminuted, and the milling chamber should be emptied. For this purpose, the emptying flap 9 is provided in the bottom region of the mill housing 1, the flap 9 adjoins the perforated screening plate 7 in the circumferential direction and is capable of being opened by a pivot movement after unlocking. The coarse milling material remaining in the milling chamber is quickly ejected, through the bottom opening of the mill housing, by the milling unit of the still-rotating rotor. Thus, the milling chamber is emptied. Once the emptying flap 9 has been closed and locked, the hammer mill is prepared for receiving a new batch.

For renewed filling of the milling chamber 6 with milling material, the closure wall 8 is raised from the lowered operating position into the standby position above the introduction opening 11. The standby position is indicated by dash-dotted lines. The closure slide 17 is then drawn downwards and the discharge opening of the receiving device 13 is exposed. As a result, the new weighed-out material held on standby is caused by gravitational force to slide into the supply shaft 3 and, from there, into the milling chamber 6 with the rotor 2 still rotating therein as before. Since the direction of rotation 16 of the rotor coincides, in the case of the exemplary embodiment represented, with the direction of introduction of the milling material, the latter is rapidly drawn into the milling chamber by the rotating milling unit. Moreover, once the milling material has slid into the supply shaft, the closure wall 8 is rapidly lowered again from the raised standby position into the bottom, operating position. Should larger particles of the milling material block one another within the supply shaft, the risk of bridging is eliminated by the lowering closure wall, because the latter forces the milling material into the milling chamber.

In each case, the lowering of the closure wall 8 into the operating position means that the milling chamber is rapidly filled with the new milling material and the point at which the supply shaft opens into the milling chamber is closed. All the particles of the milling material enter virtually simultaneously into the milling chamber, with the result that—in conjunction with rapid emptying of the milling chamber—the same treatment duration is ensured for all particles of the batch, even if the treatment duration should be relatively short overall. Consequently, the same treatment conditions are created in the hammer mill for all the particles of the individual batches, with the result that a uniform treatment result can be expected. Furthermore, for the principal application of selective comminution, rapid filling and emptying of the milling chamber permits short process-optimized treatment times.

The hammers 4 suspended on the rotor 2 via the pivot pin 5 can be pivoted freely in a circumferential direction over a specific angular space corresponding to approximately 90°. Each hammer 4, or each row of hammers, which are arranged on the same point of the circumference, of the milling unit of the rotor is assigned in each case a stop 15 in the form of a stop strip. By corresponding arrangement of the stop strip 15, the angular space in which the hammers 4 can move is arranged non-symmetrically with respect to the radial direction. Each hammer can indeed assume the extended position, caused by centrifugal force and represented by solid lines, but in this position its flat side oriented towards the front in the direction of rotation 16 strikes against the stop strip adjacent to the front of the hammer, or it at least comes very close to the rearwardly oriented side of the stop strip.

In the case of resistance in the milling material, the hammer 4 is pushed back counter to the direction of rotation 16. If the resistance is temporarily increased to a very pronounced extent, then the hammers 4 may swing back suddenly. In order for the hammers which are adjacent in the circumferential direction not to obstruct one another in this situation, a rearward pivoting-path limitation of the hammers is also provided by the stops 15. In the rearwardly directed yielding position of a hammer 4, the latter strikes, via its rearward flat side, against the front side of the rearwardly adjacent stop 15. The forced-back striking position of the hammer, this position being indicated by dash-dotted lines, corresponds approximately to the tangential position directed rearwards in the direction of rotation 16. The non-symmetrical arrangement and the limitation of the movement space of the hammers provide, on the one hand, ample possibility for the hammers to yield to the rear, and thus careful milling, in particular after rapid filling of the milling chamber.

It is preferred for the dimensioning of the angular space available for the hammers to move freely to be somewhat greater than 90°. Taking as a departure point a 90°-angular space which is located non-symmetrically with respect to the radial position and is defined, on the one hand, by the radial extended position and, on the other hand, by the rearwardly directed tangential position of the hammers, the angular space limited by the stop plates 15 is designed such that the hammers, on the one hand, can pivot out—in advance of the rotation—by approximately 15° to 25° beyond the radial extended position. On the other hand, i.e. in the region of the rearwardly directed tangential position, further pivoting of up to approximately 10° should be permitted. The intention is that the pivoted-back hammers, in the rearward striking position, still project to a considerable extent beyond the rotor discs by means of one longitudinal side.

As has already been mentioned above, only low 20 applied-force intensities are necessary or desired for selective comminution—in comparison with conventional comminution operations in hammer mills. On account of this, the hammer mill has to be operated at a correspondingly lower speed of rotation. The centrifugal forces at the comparatively low speeds of rotation are not sufficient to position the hammers, rotating in the milling material, such that they are constantly radially upright. On the contrary, in particular at the beginning of treatment, the hammers are deflected rearwards to the full extent. The stop plates prevent the hammers from being deflected excessively or from penetrating to the full extent between the rotor discs. This results in a high overall comminution performance being achieved even if material which has been roughly comminuted beforehand is introduced. It is also possible for low wear to be achieved by the hammer and stop plate meeting surface-to-surface. Since, on account of the outer stop plates, the hammers cannot jam with respect to one another—for example due to build-ups—a high degree of operational 10 reliability is also achieved.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A hammer mill for batchwise operation in which milling material introduced into a milling chamber is held for a specific treatment time, the hammer mill comprising:

a rotor rotatably arranged in the milling chamber and having pendulum-mounted hammers fitted thereon;

a stationary mill housing surrounding the rotor, said stationary mill housing enclosing a cylindrical milling chamber in a rotor region;

a supply shaft aligned so as to open tangentially into the milling chamber approximately in a gravitational force direction, said supply shaft being closable by a movable closure wall in a transition region between the milling chamber and the supply shaft;

an emptying device fitted on a bottom of the milling chamber in the gravitational force direction for discharging a coarse fraction of the milling material from the milling chamber in a batchwise manner;

wherein the supply shaft has one of a rectilinear and prismatic design with a cross-section and a length dimensioned so as to have a capacity such that, when compared with the milling chamber being filled to a full extent with a loose fill of milling material, the supply shaft receives at least 1.1 times said full extent of the loose fill;

a longitudinal guide arranged in the supply shaft for displacing the movable closure wall back and forth along the length of the supply shaft between a raised standby position and an operating position lowered onto a circumference of the milling chamber such that the milling material introduced into the supply shaft when the closure wall is in the raised standby position is forcible into the milling chamber and held therein by the movable closure wall being displaced in the direction of the milling chamber;

an introduction opening arranged in the supply shaft beneath the movable closure wall when in the raised standby position, wherein a receiving volume of the supply shaft located beneath the introduction opening is large enough for a complete milling-chamber fill to be received therein;

an introduction hopper fitted on the outside of the supply shaft in front of the introduction opening, said introduction hopper being closed at a bottom and receiving a milling-chamber fill, wherein the introduction hopper includes a discharge opening which opens into the introduction opening of the supply shaft;

wherein a pivot path of the pendulum-mounted hammers is limited to a rear, at least in the rotation direction, via stops arranged such that a forced-back striking position of at least one of the pendulum-mounted hammers corresponds approximately to a tangential position directed rearwards in the rotation direction or to a position pivoted by not more than approximately 10° beyond the tangential position, such that the hammers in the forced-back striking position project with their leading longitudinal side beyond discs of the rotor which bear the hammers.

2. The hammer mill according to claim 1, wherein the cylindrical milling chamber includes a perforated screening plate located at the bottom of the cylindrical milling chamber in the gravitation force direction for continuously and automatically discharging a fine fraction of the milling material.

3. The hammer mill according to claim 1, wherein the emptying device is one of a flap and slide.

4. The hammer mill according to claim 1, wherein the introduction hopper is designed as a receiving device coupled to a weighing machine for weighing the material therein, the introduction hopper having a closure slide fitted at a bottom end; and wherein said closure slide is suspended such that it can move in a fully unobstructed manner in a vertical direction with respect to the supply shaft within limits of the weighing movement, whereas it otherwise is assigned a constant position relative to the supply shaft.

5. The hammer mill according to claim 1, wherein each one of said pendulum-mounted hammers or each row of said pendulum-mounted hammers arranged on a same circumferential point of the rotor are assigned in each case to one of a stop and stop strip such that when the hammers are in an extended position caused by centrifugal force, each of said hammers strikes against a flat side of the stop adjacent to a front of the hammer oriented counter to the rotation direction; and wherein when the hammers are in a forced-back yielding position caused by resistance, each of said hammers strikes against a leading side of the stop adjacent to a rear in the rotation direction.

6. The hammer mill according to claim 5, wherein the stops are fitted such that a leading striking position of the hammers is located within an angular range delimited on the one hand by a radially extended position and, on another hand, by a position pivoted by not more than approximately 25° beyond the extended position in the rotation direction.

7. A hammer mill for batchwise operation in which milling material introduced into a milling chamber is held for a specific treatment time, the hammer mill comprising:

a rotor rotatably arranged in the milling chamber and having pendulum-mounted hammers fitted thereon;

a stationary mill housing surrounding the rotor, said stationary mill housing enclosing a cylindrical milling chamber in a rotor region;

a supply shaft aligned so as to open tangentially into the milling chamber approximately in a gravitational force direction, said supply shaft being closable by a movable closure wall in a transition region between the milling chamber and the supply shaft;

an emptying device fitted on a bottom of the milling chamber in the gravitational force direction for discharging a coarse fraction of the milling material from the milling chamber in a batchwise manner;

wherein the supply shaft has one of a rectilinear and prismatic design with a cross-section and a length dimensioned so as to have a capacity such that, when compared with the milling chamber being filled to a full extent with a loose fill of milling material, the supply shaft receives at least 1.1 times said full extent of the loose fill;

a longitudinal guide arranged in the supply shaft for displacing the movable closure wall back and forth along the length of the supply shaft between a raised standby position and an operating position lowered onto a circumference of the milling chamber such that the milling material introduced into the supply shaft when the closure wall is in the raised standby position is forcible into the milling chamber and held therein by the movable closure wall being displaced in the direction of the milling chamber, wherein the specific treatment time is approximately accurately maintained for all loose fill in each batch;

an introduction opening arranged in the supply shaft beneath the movable closure wall when in the raised standby position, wherein a receiving volume of the supply shaft located beneath the introduction opening is large enough for a complete milling-chamber fill to be received therein;

an introduction hopper fitted on the outside of the supply shaft in front of the introduction opening, said introduction hopper being closed at a bottom and receiving a milling-chamber fill, wherein the introduction hopper includes a discharge opening which opens into the introduction opening of the supply shaft;

wherein a pivot path of the pendulum-mounted hammers is limited to a rear, at least in the rotation direction, via stops arranged such that a forced-back striking position of at least one of the pendulum-mounted hammers corresponds approximately to a tangential position directed rearwards in the rotation direction or to a position pivoted by not more than approximately 10° beyond the tangential position, such that the hammers in the forced-back striking position project with their leading longitudinal side beyond discs of the rotor which bear the hammers.

* * * * *